United States Patent [19]

Biernot et al.

[11] 4,019,360

[45] Apr. 26, 1977

[54] WIRE ROD ROLLING MILL

[76] Inventors: Oskar Biernot, Ensheimer Str. 48; Albert Bier, Am Klosterhang 15, both of St. Ingbert, Germany, 6670

[22] Filed: Sept. 22, 1975

[21] Appl. No.: 615,609

[30] Foreign Application Priority Data

Oct. 1, 1974 Germany ..... 2446905

[52] U.S. Cl. ..... 72/249

[51] Int. Cl.² ..... B21B 35/02

[58] Field of Search ..... 72/249, 234, 235, 226, 72/238

[56] References Cited

UNITED STATES PATENTS

| | | | |
|---|---|---|---|
| 2,757,556 | 8/1956 | Uebing | 72/249 X |
| 3,595,055 | 7/1971 | Rohde | 72/226 |

*Primary Examiner*—Milton S. Mehr
*Attorney, Agent, or Firm*—John J. Dennemeyer

[57] ABSTRACT

A wire rod rolling mill has a plurality of rolling stands with individual drive shafts connected to at least one main drive shaft through respective couplings which are selectively disengagable to interrupt the drive of the corresponding roll stand. The coupling means consist of meshing bevel gears on the main drive shaft and the respective roll stand drive shaft, and a slidable member rotationally fast with one of these shafts and slidable into and out of driving engagement with the corresponding bevel gear which is rotatable relative to the shaft. Alternatively, a similar coupling arrangement may be provided between two sections of the roll stand drive shaft, these sections being interconnected by spur gears. The sets of bevel gears between the main drive shaft and the rolling stand drive shafts are equal in their transmission ratios and the speed variation in the respective roll stands is achieved by spur gearing in the rolling stand drive shafts.

4 Claims, 2 Drawing Figures

WIRE ROD ROLLING MILL

Figure 1:
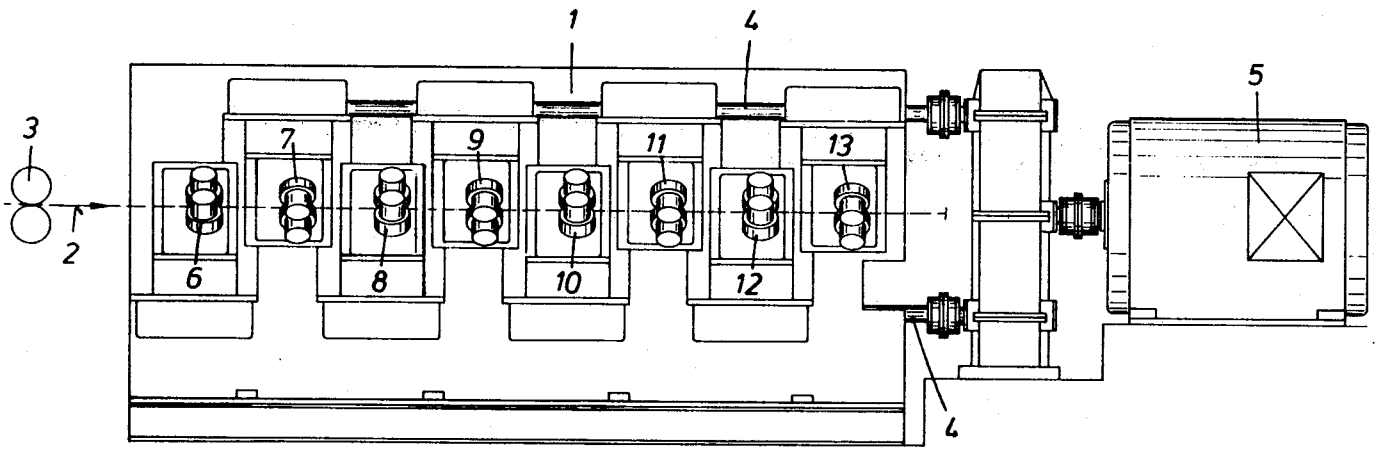

The invention relates to a wire rod rolling mill in-block form, referred to below as a wire block, having at least one longitudinal shaft which is driven by at least one controllable direct current motor, transverse shafts for driving the stands being connected to the longitudinal shaft by way of bevel gear wheels, wherein the rotational speed of the longitudinal shaft can be increased, if it is desired to roll larger intermediate cross sections supplied from a stand preceding the last rolling stand, by means of the controllable direct current drive for the purpose of adjusting the rolling speed to an increased entry speed of the rolled material into the first stand of the wire block.

In a wire block according to German Offenlegungsschrift 1,427,974 the flying rolling discs can be easily removed if instead of a smallest possible wire rod cross section a larger intermediate cross section from a rolling stand preceding the last stand is to be rolled. By means of the controllable direct current drive the rotational speed of the longitudinal shaft can be increased in order to raise the last intermediate stand in operation use to suit a higher exit speed of the intermediate cross section consequent upon an increased entry speed of the material into the first stand of the wire block. This increased entry speed results from the raising of the rolling speeds in the rolling train preceding the wire block when a final cross section is to be rolled which is not the final wire rod cross section.

This increase of the rotational speed of the longitudinal shaft, however, very quickly reaches a limit, because the last rolling stands, although the rolling discs thereof have been dismantled, are also driven. The higher the selected exit speed of the wire rod issuing from the last stand, the less latitude exists for a further increase of the rotational speed of the longitudinal shaft. This limitation is quickly reached at the high final wire rod speeds nowadays required, if one does not wish to disregard the bearing and vibration problems at the high rotational speeds of the last rolling stand and to tolerate an increased liability to disturbances.

According to the present invention there is provided a wire rod rolling mill comprising a plurality of roll stands, respective drive shafts of said roll stands, a variable speed drive motor, at least one main drive shaft connected to said motor and respective coupling means for transmitting the drive from said at least one main drive shaft to the roll stands, the coupling means being selectively disengageable to interrupt the drive to the corresponding roll stand.

Preferably the coupling means comprises meshing bevel gears on the main drive shaft and the respective roll stand drive shaft, and a slidable member rotationally fast with one of said shafts and slidable into and out of driving engagement with the corresponding bevel gear which is rotatable relative to the shaft.

Advantageously, the transmission ratios of all the bevel gears are equal and variations in the speed of successive roll stands are achieved by spur gearing interconnecting two sections of each roll stand drive shaft.

The coupling means may comprise meshing spur gears interconnecting two sections of each roll stand drive shaft, and a slidable member rotationally fast with one of said shaft sections and slidable into and out of driving engagement with the corresponding spur gear which is rotatable relative to the shaft.

An intermediate rolling stand is preferably capable of operating at an exit speed of 25 m/s when used as the final rolling stand for rolling 12 mm diameter rod coupling means associated with the subsequent rolling stands disengaged.

The drive motor is preferably a d.c. electric motor.

The invention enables the exit speed of an intermediate roll stand, when used as the last operative roll stand, to be increased to a value which is limited only by the operational reliability of this stand, without regard to the bearing and vibration problems in the subsequent rolling stands not then being required. The effect of the measures according to the invention resides in a sudden increase of the production of the wire rod rolling mill which production increases dependently upon the increase in cross section of an intermediate cross section issuing from a stand preceding the last rolling stand. If, for example, the fourth stand from the end is adjusted for approximately 12 mm round rod and has a through travel speed of 16 m/s for a final wire rod speed of 60 m/s, an exit speed of 25 m/s is attainable in this stand by an increase of the rotational speed when an intermediate cross section of 12 mm round rod is to be rolled as final product. This corresponds to an increase factor of approximately 1.56. If the assumed final wire end speed of 60 m/s is multiplied by this increase factor, the last stand would have to run at a rotational speed corresponding to an exit speed of approximately 93.6 m/s if it were not possible to disconnect it as provided for by the invention. Such an increase of the rotational speed during rolling of, for example, 12 mm round rod would not be justifiable from the point of operational reliability even if it were possible from the point of view of design of the direct current drive.

The possibility of disconnecting rolling stands and the possible manner of operation resulting therefrom of the wire block at an optimum exit speed of intermediate cross sections renders it possible to afford all bevel gear drives the same transmission ratio and to adjust the fixed gradation of the rotational speeds of the stand by means of spur wheel pairs having transmission ratios which differ from stand to stand as is known per se (French patent specification No. 1,465,499). In the wire block according to the invention, however, the pairs of spur wheels are to divide each transverse shaft into two shaft portions of which the shaft on the takeoff side drives one of two pinions. This design of the drive has the advantage that the expensive bevel gears for all rolling stands may have the same size, a design which was not suitable in modern wire blocks with high final wire end speed as long as the last stands had always to be driven even when they were not used for rolling. The pairs of spur wheels which then also rotated would have additionally increased the bearing problem and would have further limited downwardly the increase, possible per se, of the rotational speed of the longitudinal shaft for rolling of intermediate cross sections.

Figure 2:
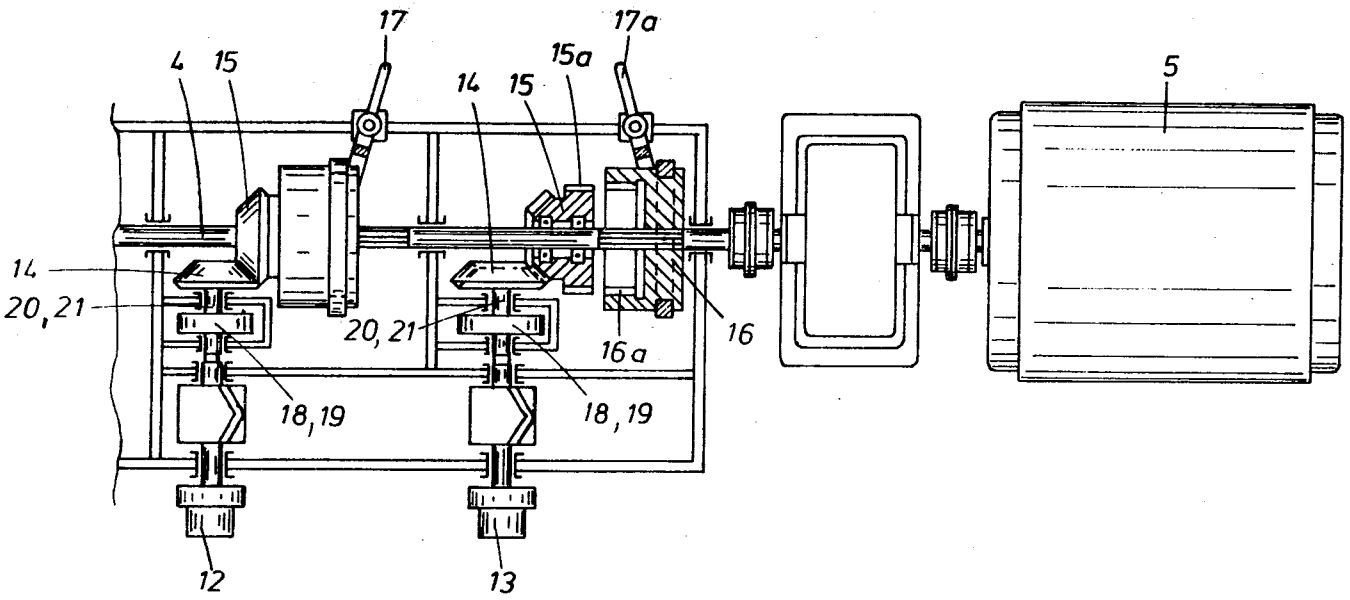

One constructional example of a wire block according to the invention is illustrated in the drawing, in which:

FIG. 1 illustrates the wire block in front view with a preceding 2-high stand, and FIG. 2 illustrates a section through the longitudinal shaft of the wire block with coupling devices disposed on the longitudinal shaft.

The wire block 1 illustrated in FIG. 1, consists of eight rolling stands 6 to 13 which are disposed in H-V (horizontal-vertical) construction and which are driven by means of two longitudinal shafts 4 by a controllable direct current motor 5 by way of an interposed gear box. The wire block 1 is preceded by a 2-high stand 3.

The rod issuing from the stand 3 in the direction of travel 2 is supplied to the wire block 1 and rolled in the stands 6 to 13 to the usual wire rod thickness of 5.5 mm diam.

When rolling wire rod of larger cross section, e.g. 12 mm diam., the final pass occurs in a rolling stand which precedes the rolling stand 13, for example, in rolling stand 10. In order that the rolling stand can be operated at a higher final speed than allocated thereto for rolling 5.5 mm diam., the rolling stands 11 to 13 are brought to standstill.

FIG. 2 illustrates the rolling stand 12 in operation and the rolling stand 13 at standstill. The longitudinal shaft 4 has mounted thereon bevel wheels 15 integral with a toothed boss 15*a*. By moving a pivotally mounted control lever 17 into the position 17*a* internal teeth 16*a* of a coupling sleeve 16 splined on the shaft 4 are disengaged from the bevel wheel 15 which is thus rotationally disengaged from the shaft 4 whereby the rolling stand is stopped.

The bevel wheel stages 14, 15 illustrated have the same transmission ratios, and the gradation of the rotational speeds of the rolling stands 6 to 13 is effected by spur gear pairs 18, 19 which are disposed on the transverse shafts 20, 21 and which have transmission ratios which differ from stand to stand.

In a modification the coupling sleeves for stopping the rolling stands are disposed on the transverse shafts 20 in order that either the bevel wheels 14 or the spur wheels 18 may be disengaged.

What is claimed is:

1. A wire rod mill, comprising:

a plurality of serially arranged roll stands;

at least one lontitudinal main drive shaft, said main drive shaft serving as a common drive shaft for all of said roll stands;

a variable speed drive motor connected to said main drive shaft;

a plurality of transverse shafts, one for each of said roll stands;

first coupling means connecting each transverse shaft with its associated roll stand for driving said roll stand at a selected speed from said transverse shaft; and a plurality of second coupling means, one for each transverse shaft, for connecting said transverse shafts with said common main drive shaft in a fixed, predetermined transmission ratio, the second coupling means associated with the final one of said roll stands in said series, and the second coupling means associated with at least a plurality of roll stands next preceeding said final roll stand, each including means for selectively and individually disconnecting their associated transverse shafts from said common main drive shaft.

2. A wire rod mill as recited in claim 1, wherein said second coupling means comprises:

a first bevel gear fixed on one of said transverse shaft and said main drive shaft;

a second bevel gear rotatably mounted on the other of said transverse shaft and said main drive shaft, and engaged with said first bevel gear; and coupling sleeve means slidably mounted on said other of said transverse shaft and said main drive shaft and rotatable therewith, said coupling sleeve means being slidable into and out of engagement with said second bevel gear to respectively connect and disconnect said common main drive shaft with the associated transverse shaft.

3. A wire rod mill as recited in claim 2, wherein the transmission ratios of all the sets of first and second bevel gears are equal, and each of said first coupling means comprises spur gears that can be changed to achieve different transmission ratios.

4. A wire rod rolling mill as recited in claim 1, wherein said variable speed drive motor is a d.c. electric motor.

* * * * *